US006142815A

United States Patent [19]

Whiteman, Jr. et al.

[11] Patent Number: 6,142,815

[45] Date of Patent: Nov. 7, 2000

[54] ELECTRICAL INTERFACE CONNECTOR

[75] Inventors: Robert Neil Whiteman, Jr., Middletown; Earl William McCleerey, Mechanicsburg; Michael Eugene Shirk, Grantville; Douglas Morgan Walburn, Linglestown; Robert Wayne Walker, Harrisburg, all of Pa.

[73] Assignee: The Whitaker Corporation, Wilmington, Del.

[21] Appl. No.: 09/170,631

[22] Filed: Oct. 13, 1998

Related U.S. Application Data

[60] Provisional application No. 60/064,999, Nov. 10, 1997.

[51] Int. Cl.[7] ..... H01R 13/645

[52] U.S. Cl. ..... 439/381

[58] Field of Search ..... 439/381, 410, 439/630, 705, 380, 59, 801, 378

[56] References Cited

U.S. PATENT DOCUMENTS 5,595,505 1/1997 Duke et al. ..... 439/630

OTHER PUBLICATIONS

U.S. Ser. No. 09/056,083 filed Apr. 7, 1998 (Abstract and drawings only).

*Primary Examiner*—Steven L. Stephan
*Assistant Examiner*—Eugene G. Byrd
*Attorney, Agent, or Firm*—Michael Aronoff

[57] ABSTRACT

A plurality of interface modules (200,300,400,500) having identical first mating interfaces (202,302) for mating with the mating face (100) of a cable tap connector (10), to enable interconnection therewith at second mating interfaces by different types of electrical conductors. A set of contacts in each module have identical first contact sections (212,318) along the first mating interface, and the contacts are secured in the module housing (206,306) under an insulative retention plate (210,360) that assuredly secures the contacts in proper position for accurate positioning of the first contact sections. The insulative plate (210,360) also protects the first contact sections during handling of the module.

15 Claims, 11 Drawing Sheets

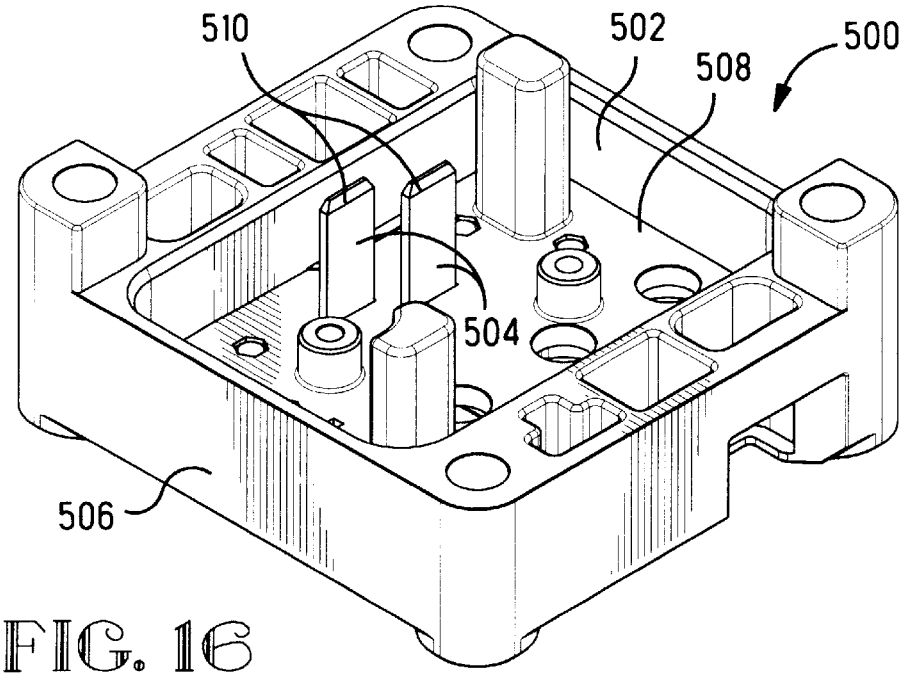
FIG. 16
FIG. 18
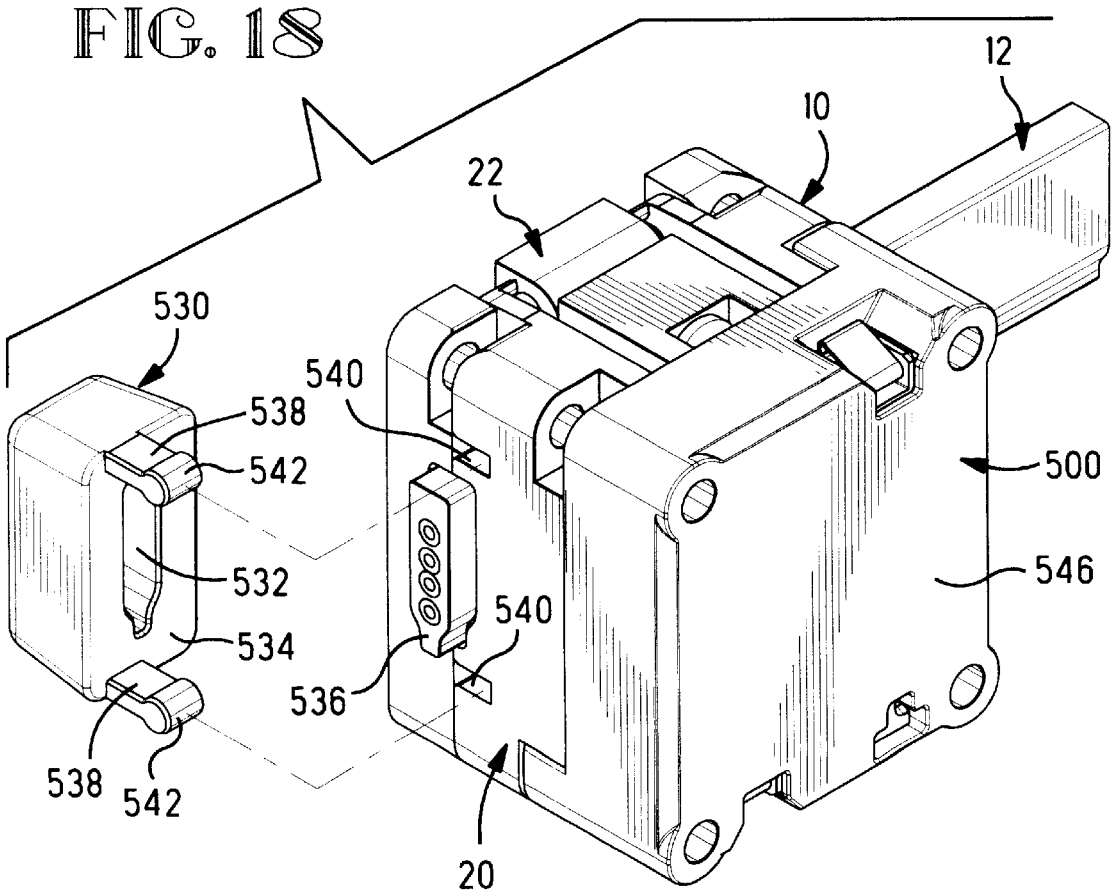

ELECTRICAL INTERFACE CONNECTOR

Priority is claimed from provisional application No. 60/064,999 on Nov. 10, 1997.

FIELD OF THE INVENTION

This relates to the field of electrical connectors and more particularly to connectors for establishing a tap connection to multiconductor cable.

BACKGROUND OF THE INVENTION

For establishing taps to cables such as heavily jacketed cables having a plurality of conductors for transmission of electrical power, especially direct current power, or transmission of both power and signals, it is desired to provide a plurality of interface connectors each matable with the cable tap connector.

It is further desired to provide a common mating interface for the interface connectors.

SUMMARY OF THE INVENTION

Each of a plurality of interface connector modules includes a housing, an array of contacts, and a retention plate for securing the contacts to the housing and assuredly maintaining them in position during shipping and handling, and during mating and unmating. While the housings may differ from each other to define second mating interfaces, the retention plate used for all the housings assures, along with identical first contact sections of the contacts and latching and alignment posts of all the modules, that the first mating interfaces of the modules are all identical to mate with the cable tap connector, thus allowing the same cable tap connector to be utilized in a plurality of applications. The retention plate includes apertures through which extend the first contact sections of the contacts, and mounting holes for fasteners to secure the plate to the housing.

Embodiments of the present invention will now be described by way of example with reference to the drawings.

BRIEF DESCRIPTION OF THE DRAWINGS

FIG. 16 is an isometric view of the first mating interface of a fourth interface module, comprising a terminator;

FIG. 18 is a view of the terminator of FIGS. 16 and 17 mated to the cable tap connector of FIG. 1 at an end of the cable, with an end cap that is secured over the cable end at the unused cable exit.

DETAILED DESCRIPTION OF THE EMBODIMENTS

Figure 1:
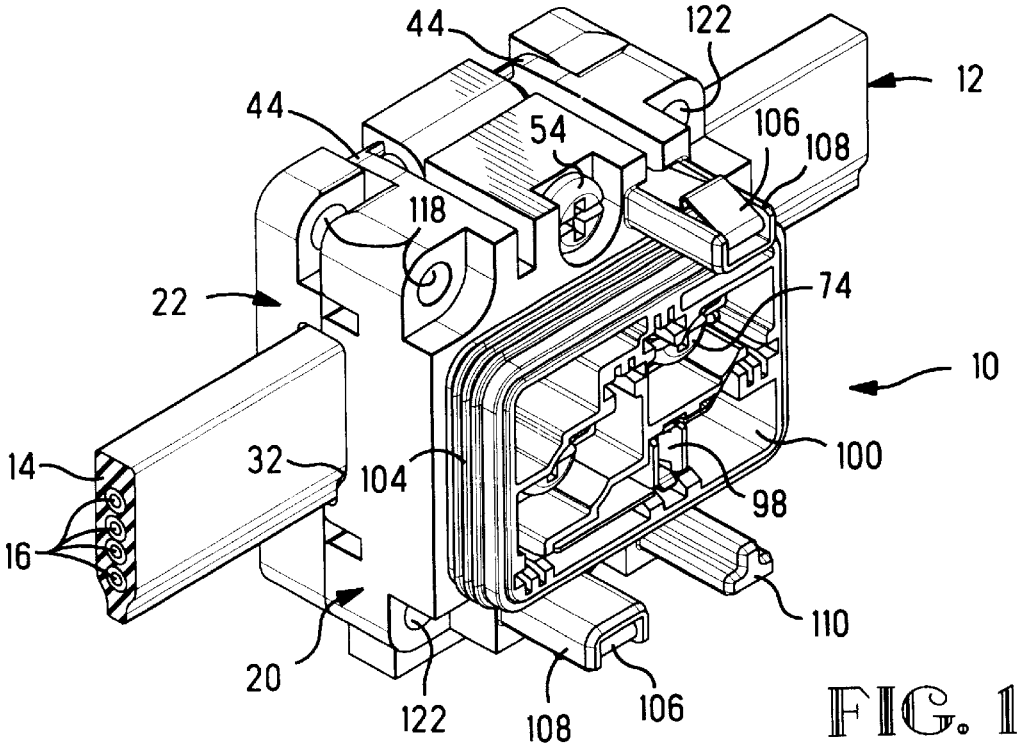
FIG. 1 is an isometric view of the cable tap connector terminated to a cable.

Cable tap connector 10 is shown terminated to a cable 12 having an outer jacket 14 and, for example, four conductors 16. Connector 10 includes an insulative housing 20 and a second insulative member, cover 22 to which it is securable to surround cable 12 at a location remote from an end of the cable, as well as at a cable end. Housing 20 and cover 22 include shallow wide grooves 24,26 along assembly faces 28,30 thereof together defining cable-receiving channel or nest 32 that will clamp about the cable. The cable cross-section is shown to include a reduced thickness flange along one side, serving to polarize the orientation of the cable tap connector with respect to the cable, its cable-receiving channel being complementarily shaped, thus assuring that the power conductors and signal conductors are positioned appropriately for termination to the appropriate contact members of the connector.

Also shown are gaskets 34,36 such as of elastomeric material that may be affixed to assembly faces 28,30 within respective gasket grooves to seal the termination region after termination, from moisture, dust and gasses of the outside environment; alternatively, sheets of mastic material may be used for sealing. Teeth 38 extend into grooves 24,26 to bite into cable 12 to assist in securing the cable in position against lateral movement. Antishear embossments 40 project from assembly face 30 of cover 22 to enter clearances 42 in assembly face 28 of housing 20 upon securing the connector to the cable, that enhance resistance to shearing should forces be applied to either the housing or the cover in a lateral direction.

Figure 8:
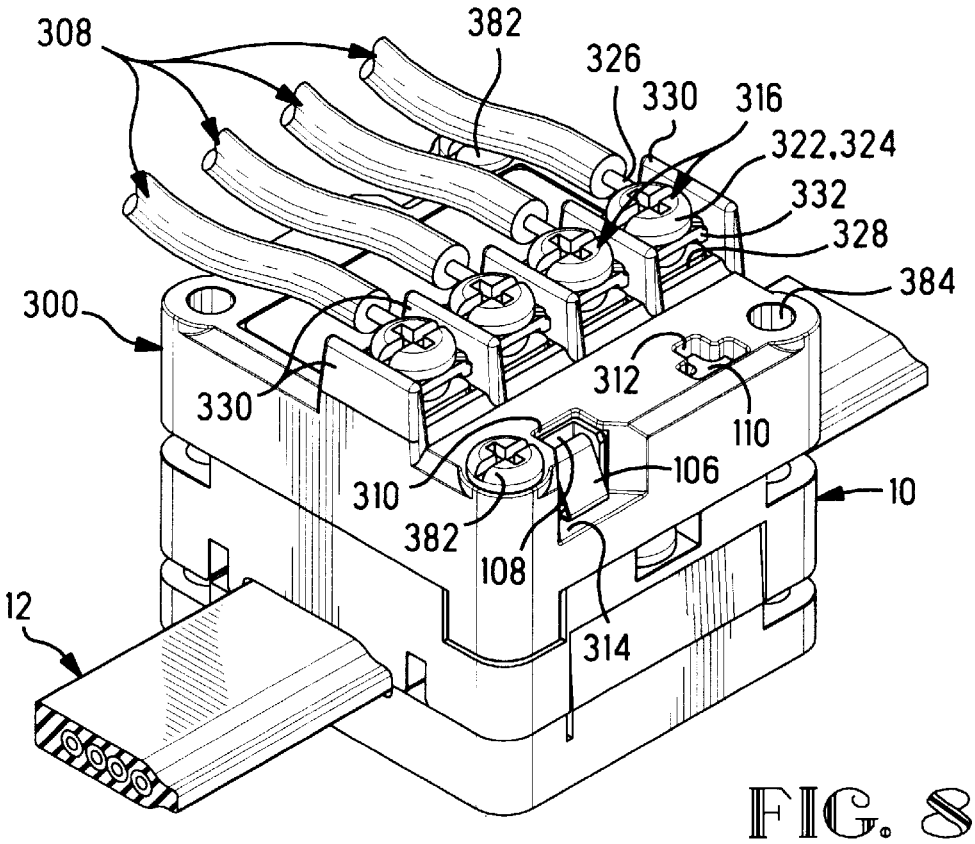
FIG. 8 is an isometric view of the cable tap connector of FIGS. 1 to 6 mated to a second interface module of the present invention for connection of discrete conductor wires to the terminals thereof along a second mating interface of the module.

Connector 10 may be mounted to a panel (not shown) by fasteners (not shown) extending through holes 118 of both housing 20 and cover 22 at a first pair of opposed corners, or a bracket (not shown) may be secured to cover 22 to enable clamping to a DIN rail (not shown), by fasteners extending through holes 118, as is disclosed in U.S. patent application Ser. No. 09/056,083 filed Apr. 7, 1998 and assigned to the assignee hereof. Optionally, cover 22 may be panel mounted directly, using fasteners through holes 118, with clearances seen in FIG. 1 provided for enlarged fastener heads. Threaded female inserts 120 are preferably affixed within holes 122 at a second pair of opposed corners, for threading thereinto and unthreading therefrom of screws 384 when an interface module has been mated to cable tap connector 10 as seen in FIG. 8.

Figure 3:
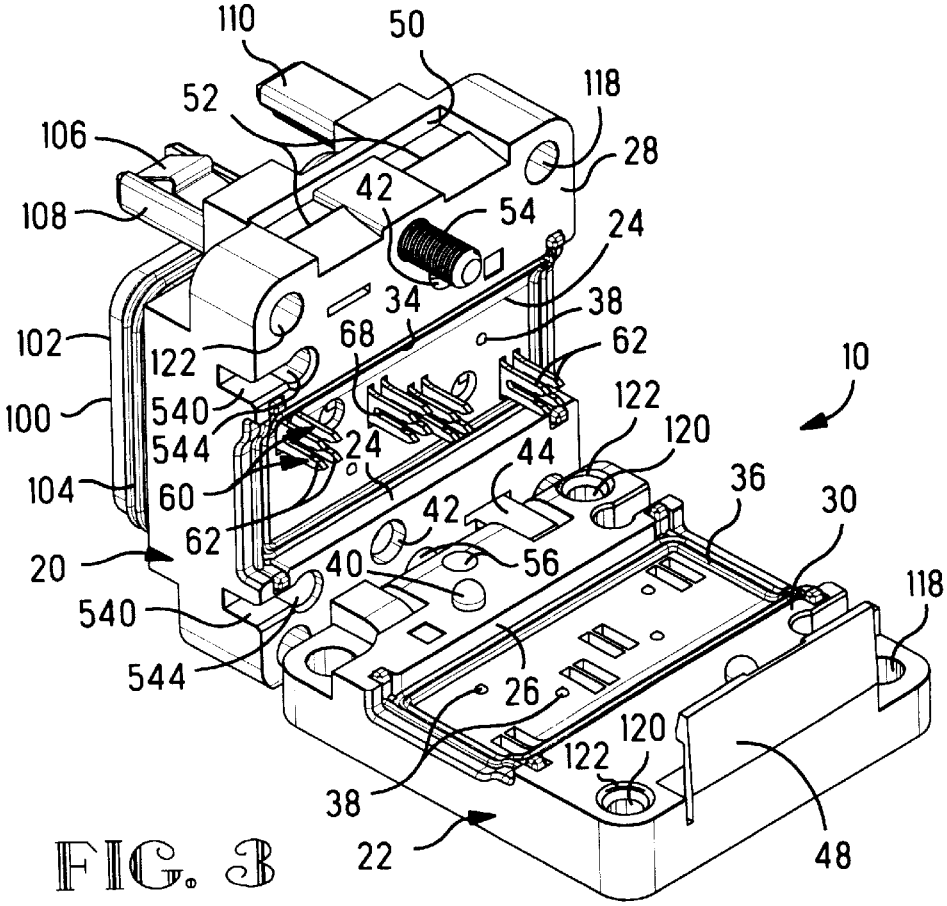
FIG. 3 is an isometric view of the housing and the cooperating cover of the cable tap connector of FIGS. 1 and 2 hingedly joined in an open condition, but with the contacts shown in the actuated position for illustrative purposes.
Figure 2:
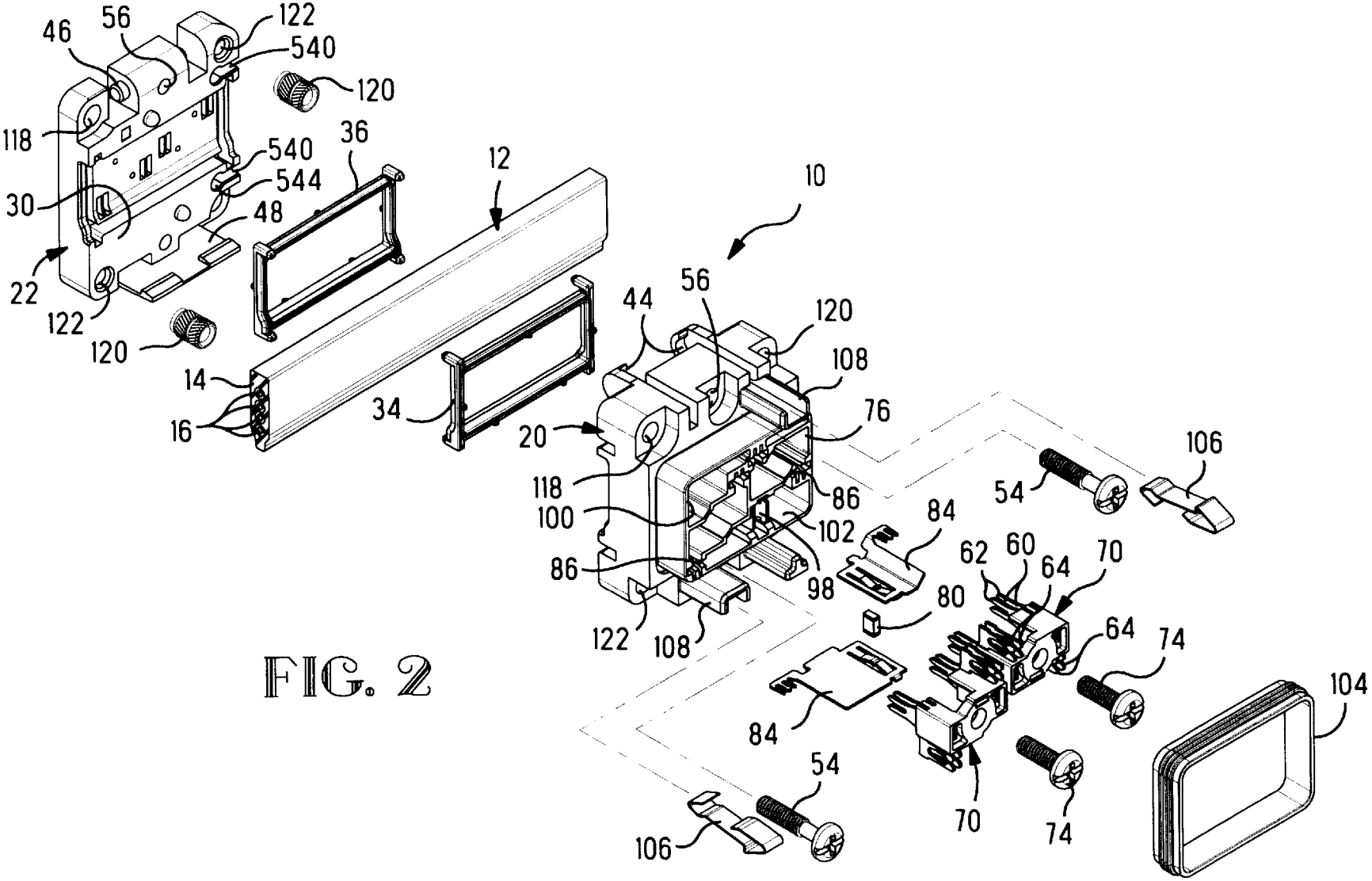
FIG. 2 is an exploded isometric view of the connector of FIG. 1.

Referring to FIGS. 1 to 3, housing 20 and cover 22 are securable to each other about cable 12; preferably, housing 20 and cover 22 are hingedly joined to each other, to be rotated together for assembly faces 28,30 to meet about the cable for grooves 24,26 to form cable-receiving channel 32. Housing 20 includes along one side a pair of pivot sections 44 cooperable with pivot pins 46 of cover 22 to pivot housing 20 toward cover 22. Latch arm 48 extends upwardly from assembly face 30 of cover 22 on the opposed side from pivot pins 46, to be received into a latch-receiving recess 50 and latch with projections 52 of housing 20 along the opposed side, with the latch-receiving recess being a tamper-resistance feature to inhibit delatching of latch arm 46. Fasteners 54 are insertable through holes 56 of housing 20 to thread into apertures 56 of cover 22 to complete securing the housing to the cover prior to cable termination.

Now referring to FIGS. 2 to 7, connector 10 includes a plurality of contacts 60, associated in pairs with respective conductors 16 of cable 12 and having insulation displacement (IDC) or first contact sections 62 that will compressively engage conductors 16 upon termination, after connector 10 is assembled around the cable. The provision of a pair of contacts engaging each conductor increases the current-carrying capacity of the connector, with attendant advantages of substantially reduced heat generation and related temperature rise and substantially reduced losses, as well as redundancy. Contacts 60 also have second contact sections 64 exposed along mating face 100 of housing 20 after assembly and termination, for electrical connection with complementary contacts of an interface connector module (FIGS. 7 to 17).

Figure 6:
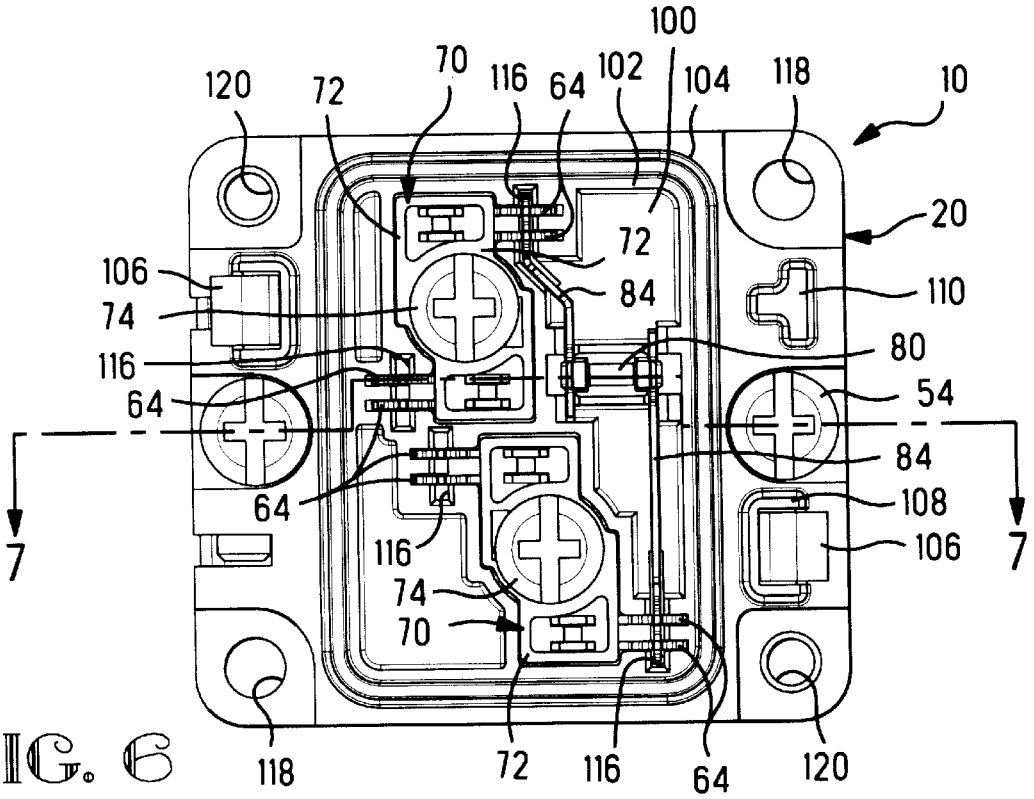
FIG. 6 is a plan view of the mating face of the cable tap connector of FIGS. 1 to 5.
Figure 7:
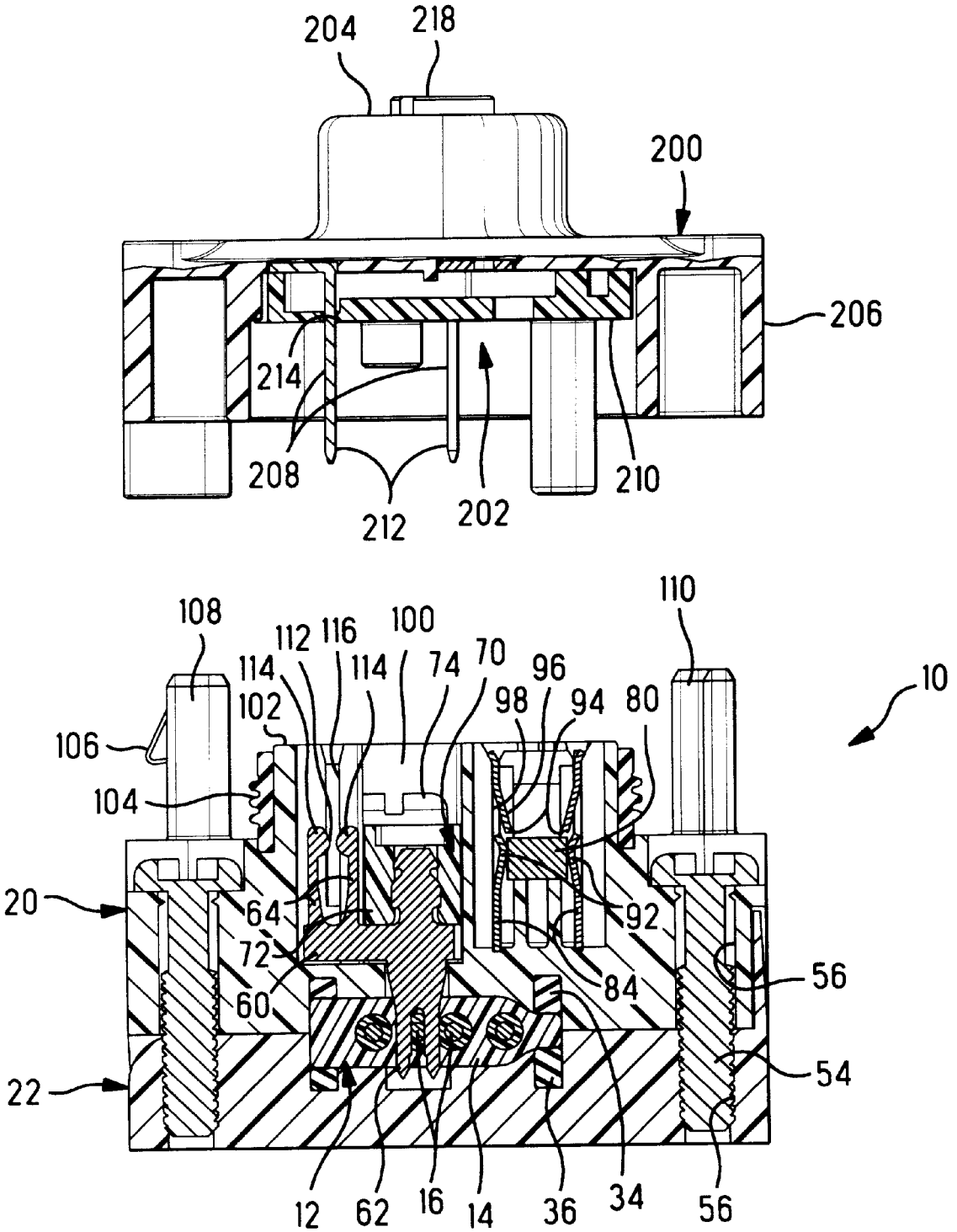
FIG. 7 is a cross-sectional view of a first interface module of the present invention positioned to mate with the connector of FIGS. 1 to 6.

As seen best in FIGS. 7 and 6, second contact sections 64 are shown to be of the tuning fork type adapted to receive blade-shaped contact sections in slots 112 thereof between resilient beams 114, as is known. Preferably, second contact sections 64 are recessed within H-shaped blade-receiving slots 116 defined by insulative housing 20 along mating face 100, with the H-shaped blade-receiving slots assuring that the blade-shaped contact sections of the interface module are aligned properly to enter the slots 112 of the tuning fork contact sections.

Figure 4:
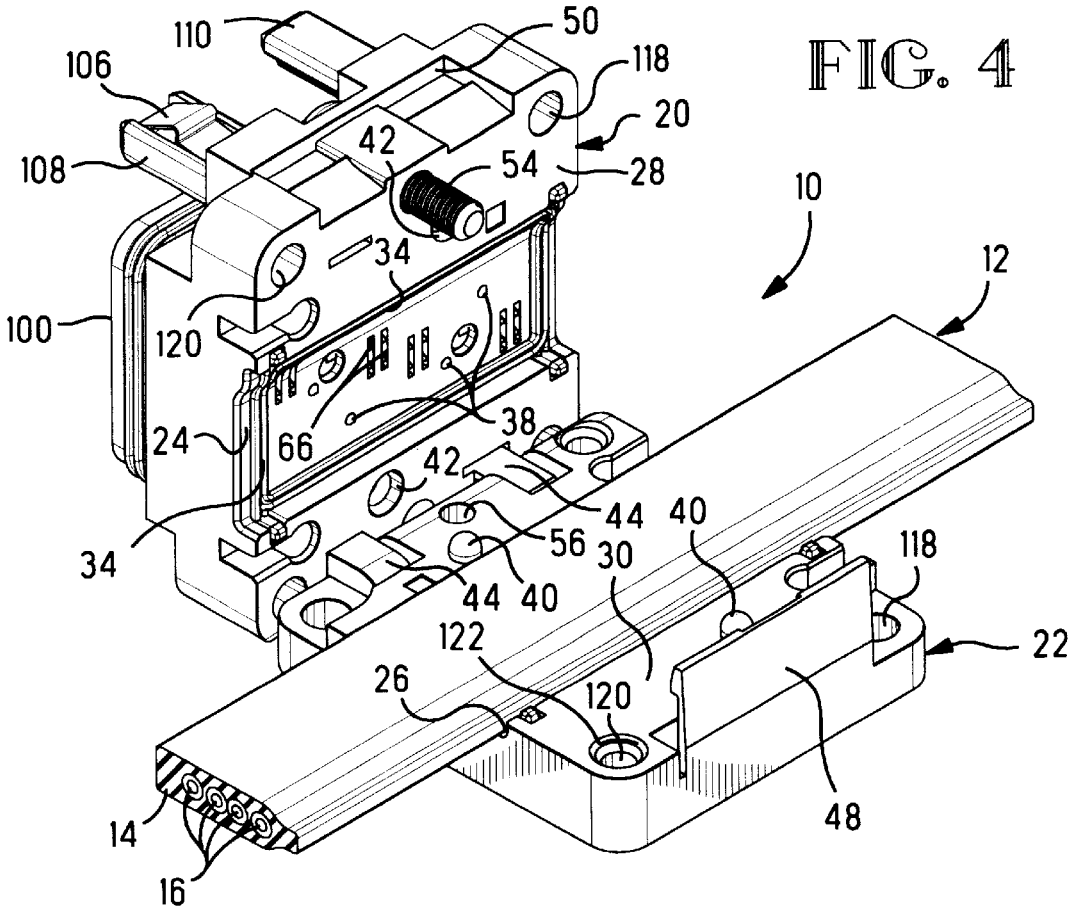
FIG. 4 is an isometric view of the connector of FIGS. 1 to 3 with a cable nested therein, with the contacts recessed prior to cable termination.
Figure 5:
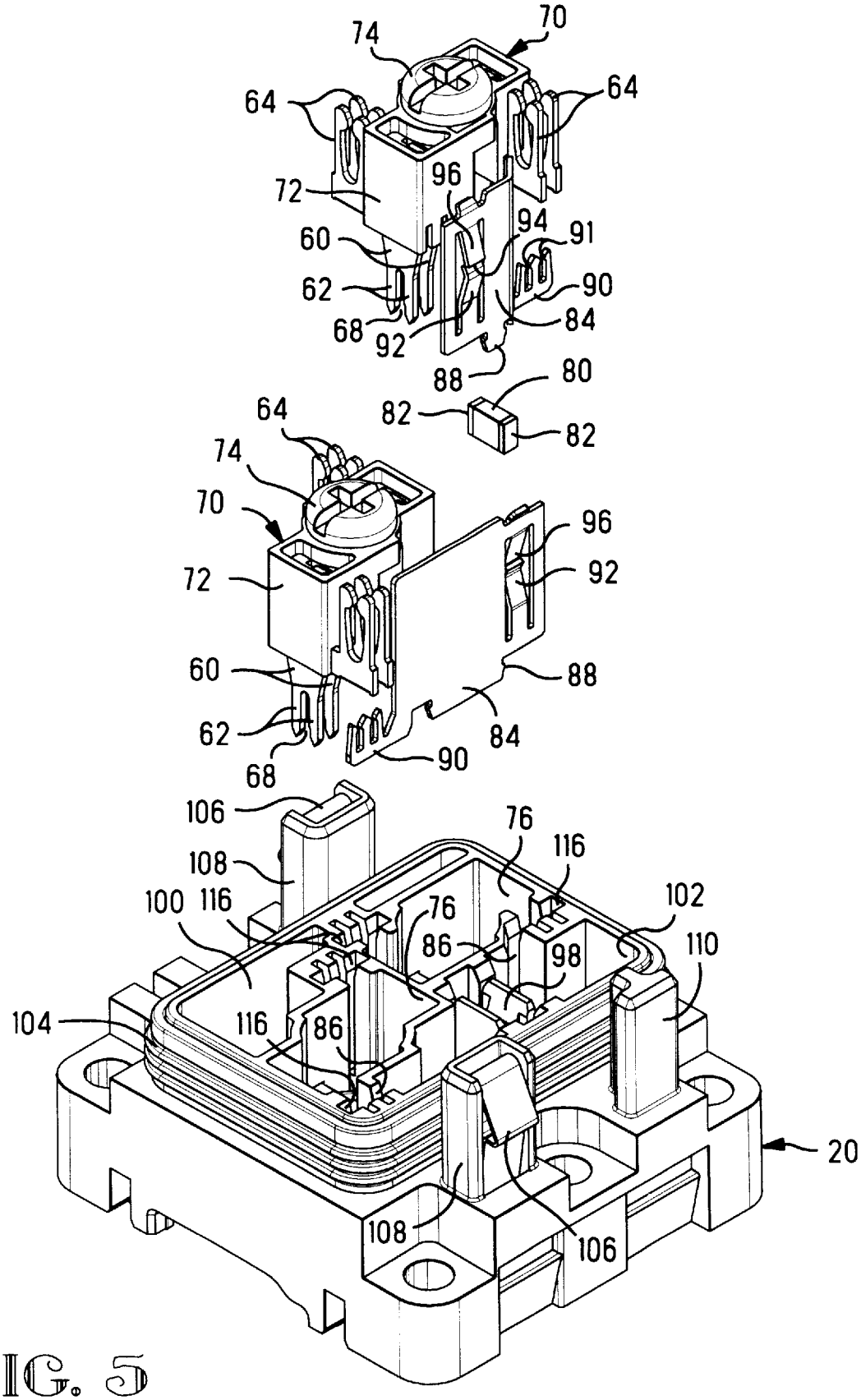
FIG. 5 is an isometric view of the upper housing of the connector of FIGS. 1 to 4 with the terminal subassemblies, a chip capacitor, and a pair of capacitor-engaging contacts exploded therefrom.

Contacts 60 are first secured within insulative carriers 72, seen best in FIGS. 2 and 5, to define terminal subassemblies 70 that also include actuators 74, and are secured therein by retention legs force fit into openings of insulative carriers 72 (see FIG. 7). The subassemblies 70 are then secured in respective cavities 76 in mating face 100 of housing 20 such that IDC contact sections 62 are disposed within respective slots 66 of housing 20 that extend from mating face 100 to cable face 28. IDC contact sections 62 are shown in FIG. 4 in their pretermination or recessed position within slots 66, and in FIG. 3 in their terminated position extending beyond cable face 28 of housing 20 into cable nest 32, for illustration purposes only, and are seen to include sharp points at ends of the beams of the contact sections to best penetrate the cable insulation upon actuation to terminate to conductors 16.

Preferably, two contact pairs are secured in each subassembly 70, associated respectively with power and signal conductors 16 of cable 12, and upon rotation of actuator 74 the contact carrier 72 moves the two pairs of contacts 60 in tandem or simultaneously toward cable 12. Initially, IDC contact sections 62 are recessed completely within slots 66 of housing 20 until after connector 10 is secured around cable 12, whereafter actuation of actuators 74 moves the contacts 60 toward the cable, when IDC contact sections 62 penetrate insulative jacket 14 of the cable and receive into their slots 68, the respective conductors 16 under assured compression to establish electrical connections therewith.

Also seen in FIGS. 2, 5 and 7 is a chip capacitor 80 having electrodes 82 at opposed ends, and a pair of capacitor-engaging terminals 84 that are affixable to housing 20 along mating face 100 within respective slots 86 by means of retention legs 88 received in interference fit into slots (not shown) of the housing 20. The capacitor-engaging terminals 84 include contact sections 90 to establish an electrical connection with one pair of contacts 60 of respective subassemblies 70 upon assembly of connector 10, in order to be connected in parallel to power circuits when the one pair of contacts 60 becomes electrically connected with a power conductor of the cable. Each capacitor-engaging terminal 84 also includes a capacitor-engaging section having a spring arm 92 that engages an associated electrode 82 of the capacitor, and a retention ledge 94 that secures the capacitor 80 in the housing as seen in FIG. 7. The retention ledge may be the free end of a deflectable arm 96 that is deflected outwardly by the capacitor during insertion of the capacitor into a pocket 98 of housing 20 along mating face 100, and thereafter resiles to a positioned above the upper surface of the capacitor. The capacitor retention and electrical connection system is disclosed in greater detail in U.S. patent application Ser. No. 09/170,632 filed Oct. 13, 1998 (concurrently herewith) and assigned to the assignee hereof.

Mating face 100 is seen to include a sealing gasket 104 of elastomeric material surrounding a shroud section 102 to seal the mating interface when an interface module such as module 200 or 300 becomes mated to connector 10, as seen in FIGS. 7 and 8. Mating face 100 also preferably includes a pair of latch members 106 along opposed sides of shroud 102 to provide latching retention of an interface module upon mating. Latch members 106 are seen to be recessed within silos 108 extending from housing 20 outside of shroud 102, to provide protection of latch members 106 during shipping, handling, and application of connector 10 to cable 12, and during mating and unmating of interface modules with and from connector 10. Silos 108 also serve as alignment members to assure that an interface module being mated with connector 10 is appropriately aligned with respect to mating face 100 for the contacts of the interface module to be aligned with second contact sections 64 of contact members 60 prior to physical engagement therewith. Additionally, connector 10 preferably includes polarization features at mating face 100, such as T-shaped key projection 110 extending upwardly from housing 20 outside of shroud 102, to assure that an interface module is appropriately oriented prior to mating of the contacts thereof with second contact sections 64 of respective pairs of contact members 60 of connector 10.

FIGS. 7 to 17 illustrate four embodiments of interface modules in accordance with the present invention, all having first mating interfaces that mate with mating face 100 of cable tap connector 10 of FIGS. 1 to 7. In FIG. 7 is shown a first interface module 200 of the type illustrated in greater detail in FIG. 13, having a first mating interface 202 and second mating interface 204. Module 200 includes an insulative housing 206, a plurality of interface contacts 208 secured therein utilizing an insulative retention plate 210 of the present invention that serves to secure the interface contacts 208 to housing 206 and also to assure that the blade-shaped contact sections 212 along first mating interface 202 extend through slots 214 of plate 210 and are positioned appropriately to correspond and be matable with second contact sections 64 of contacts 60 of cable tap connector 10. The retention plate is especially useful to counteract the moments on the contacts during unmating, since the blade-like contact sections are at an end of elongate body sections.

Referring now to FIGS. 8 to 12, a second interface module 300 having a first mating interface 302 identical to that of module 200, is illustrated in mated relationship to cable tap connector 10. Module 300 is of the type having a second mating interface 304 along an upper surface of insulative housing 306 adapted to accommodate electrical connections to discrete wire conductors 308. Insulative housing 306 includes apertures 310 into which are received silos 108 and latching ends of latch members 106 of cable tap connector 10, as well as a key-receiving aperture 312 complementary to T-shaped key 110 of connector 10 during mating. The latch members latch to latching surfaces 314 adjoining apertures 310 to latch interface module 300 to connector 10 such that the latching ends of latch members 106 are exposed to be deflected for delatching of the module from the connector if desired.

Contact assemblies 316 of module 300 include first contact sections 318, shown defined on first members 320, that are exposed along first mating interface 302 (FIG. 12) to mate with the contacts of the cable tap connector similarly to contact sections 212 of contacts 208 of module 200 as shown in FIG. 7. Contact assemblies 316 also include second contact sections 322, shown defined on second members 324 (FIGS. 8 and 9), that are shanks around which exposed conductors 326 of wires 308 will be wrapped to establish electrical connections therewith at connection sites 328 between insulative barrier walls 330. The first and second contact sections extend axially from opposed ends of a transverse body section of first member 320 and are offset from each other to correspond with different mating interfaces. Additionally, in the contact assemblies shown, square washers 332 are utilized against which the conductors 326 will be compressed by enlarged heads of second members 324 to increase the metal-to-metal interface of the conductors and the contact assemblies. The square washers fit snugly between pairs of barrier walls 330 in a manner preventing rotation thereof when the second members are rotated during connection and disconnection of wires 308.

Figure 10:
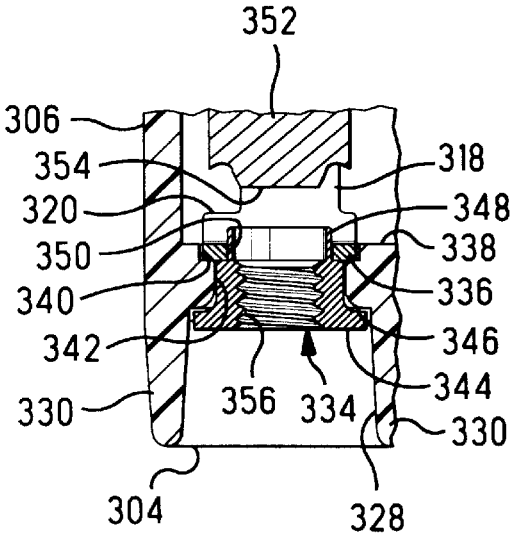
FIGS. 10 and 11 are enlarged cross-sections of portions of the first interface module of FIGS. 8 and 9 showing interconnection of first and second terminals thereof.
Figure 11:
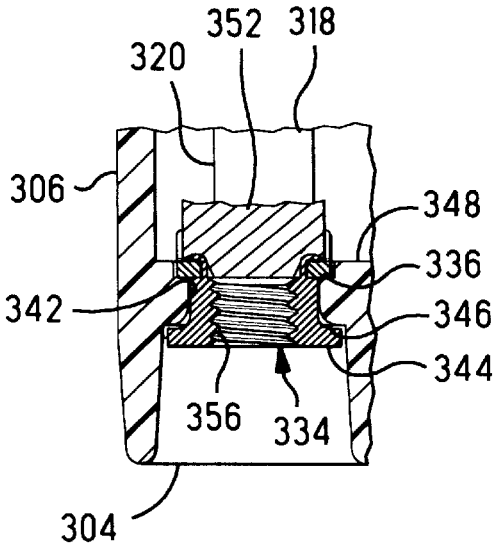
Figure 9:
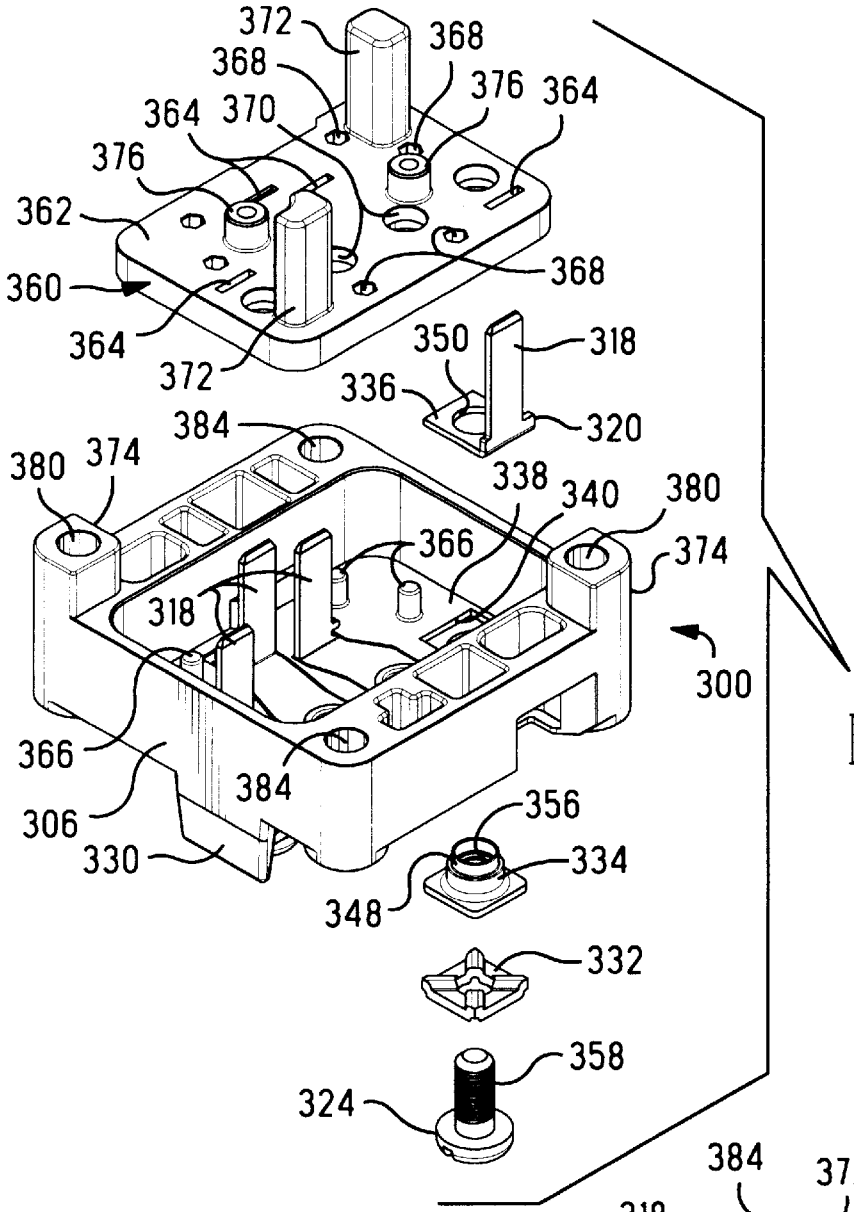
FIG. 9 is a partially exploded isometric view of the second interface module of FIG. 8.

Female threaded inserts 334 with rivet-like end flanges are utilized to assuredly mechanically and electrically connect the first and second members 320,324 as shown in FIGS. 9 to 11. Transverse body sections 336 of first members 320 are positioned against surface 338 of housing 306 and preferably seated within shallow depressions 340 thereinto that secure the first members against rotation. Inserts 334 are inserted from second mating face 304 into holes 342 of housing 306 at respective connection sites 328 until wide collars 344 seat against ledges 346 around holes 342. Reduced diameter flanges 348 extend outwardly from holes 342 and through holes 350 through transverse body sections 336 of first members 320. Then, referring to FIGS. 10 and 11, a tool 352 having an appropriately shaped work end 354 is utilized to roll the flanges 348 of inserts 334 outwardly and over the periphery of holes 350 of transverse body sections 336 of first members 320, after which the tool is withdrawn. Inserts 334 include threaded apertures 356 into which ends of threaded shafts 358 of second members (screws) 324 that comprise the second contact sections 322, after square washers 332 have been placed onto threaded shafts 358.

In FIG. 9 is seen insulative retention plate 360 having a transverse body section 362 through which extend slots 364, each associated with a respective first contact section 318. Plate 360 is secured against surface 338 of housing 306 after the contact assemblies 316 have been secured to the housing; cylindrical bosses 366 extend from housing surface 338 and are received in a tight force fit into holes 368 through plate 360, shown to be hexagonal. Optionally, the plate may be heatstaked onto housing surface 338, as is a generally conventionally known technique. Additionally, plate 360 includes clearance holes 370 into which may extend the ends of screw shafts 358.

Figure 12:
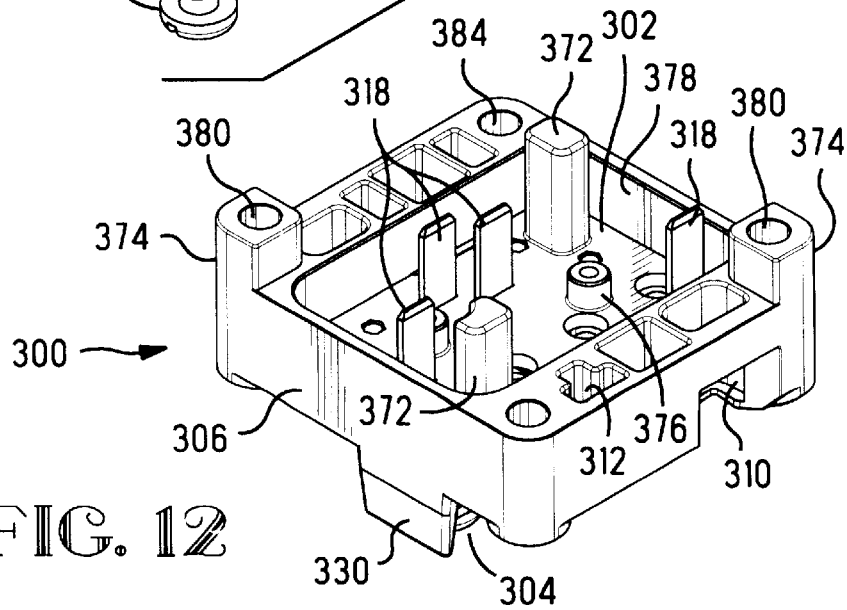
FIG. 12 is an isometric view of the first mating interface of the module of FIG. 9.

As seen in FIGS. 9 and 12, upstanding projections 372 are seen at diagonally opposed corners of plate 360, and extend to generally the same level as upstanding projections 374 of housing 306 that are positioned in remaining corners of interface module 300 upon complete assembly, with the level being farther from mating interface 302 than the free ends of first contact sections 318. Together, projections 372,374 serve to protect first contact sections 318 after complete assembly, during shipping and handling and during mating and unmating with and from cable tap connector 10, and so that the interface module may rest stablely on a support surface when not mated without damaging the contacts. Projections 374 will seat in corner recesses of cable tap connector 10 (see FIGS. 5 and 8) while projections 372 will enter clearances in the mating face within shroud 102.

Bosses 376 are provided that are aligned with actuators 74 of cable tap connector 10 and will only allow full mating of the interface module with connector 10 when the actuators have been rotated to their fully actuated position, thus preventing full mating and therefore latching of the interface module with the cable tap connector if the cable tap connector has not been fully or appropriately terminated to cable 12.

Upon assembly of insulative plate 360 to housing 306, mating face 302 can be seen to define a large cavity 378 into which is received shroud 102 of cable tap connector 10, with gasket 104 establishing an assured sealing engagement with side wall surfaces of cavity 378, thus sealing the mating interface against moisture, dust and gases of the outside environment. Holes 380 in a first pair of opposed corners through projections 374 provide for screws 382 to be inserted therethrough to be threaded into holes 120 of cable tap connector 10 to assuredly fasten the interface module to the connector after mating and latching. Holes 384 permit insertion therethrough of elongated screws (not shown) that also will extend through holes 118 of cable tap connector 10 for panel mounting or mounting to a DIN rail clamp of the entire mated assembly, if desired.

Figure 13:
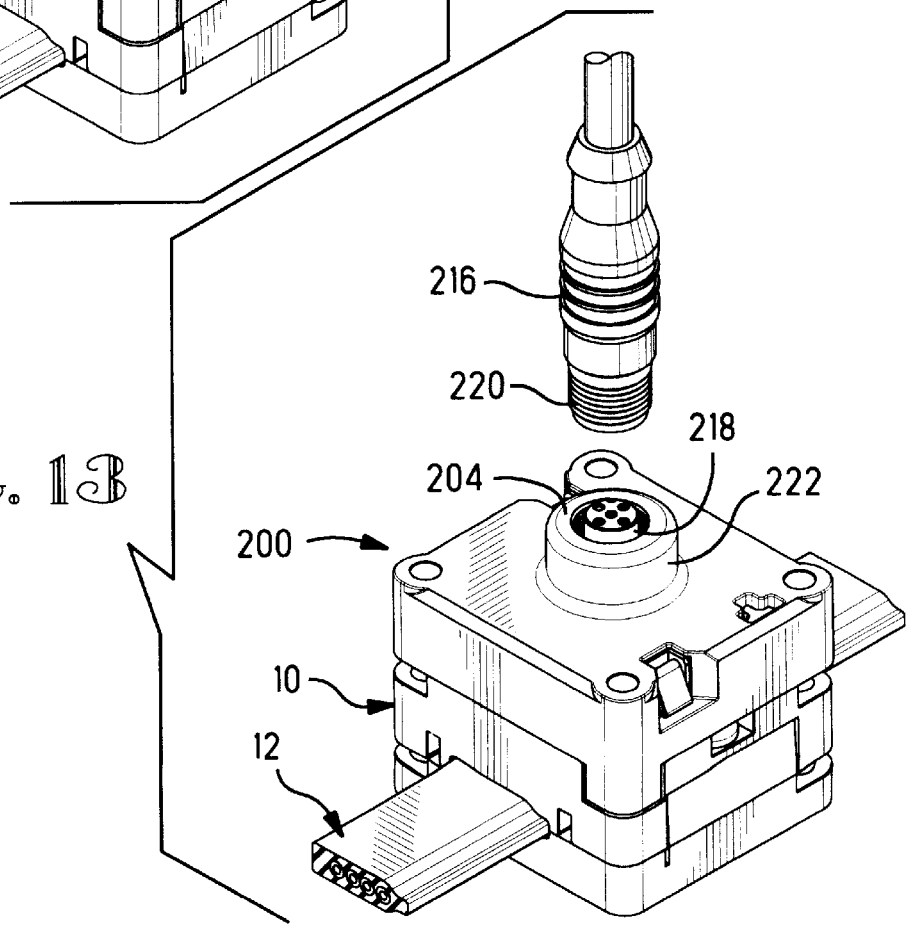
FIG. 13 is an isometric view of the first interface module of the present invention matable to a miniature round cable connector along the second mating interface.

FIG. 13 illustrates first interface module 200 (see FIG. 7) and includes a second mating interface 204 adapted to mate with a miniature round cable connector 216. Module 200 includes a cylindrical plug portion 218 for receipt into a plug-receiving cavity of connector 216 defined by a shroud within a freely rotatable coupling ring 220. An annular embossment 222 surrounds cylindrical plug portion 218 and is spaced therefrom with its inner surface being threaded. The outer surface of coupling ring 220 is threaded so that after mating of connector 216 and module 200, rotation of the coupling ring around connector 216 results in threaded engagement with embossment 222 to assuredly secure the connector 216 and module 200 in mated engagement.

Figure 14:
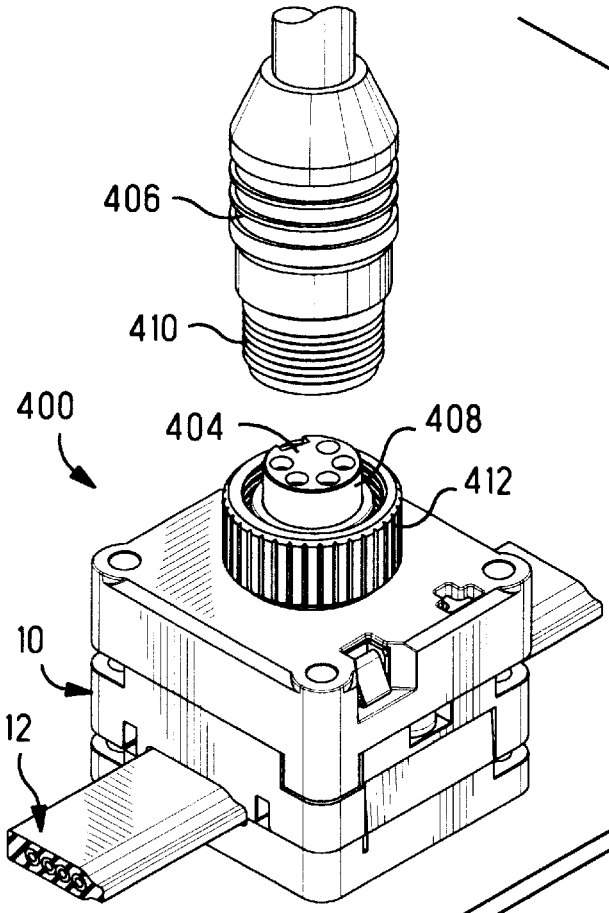
FIG. 14 is an isometric view of a third interface module similar to that of FIG. 13 and matable to a round cable connector along the second mating interface.
Figure 15:
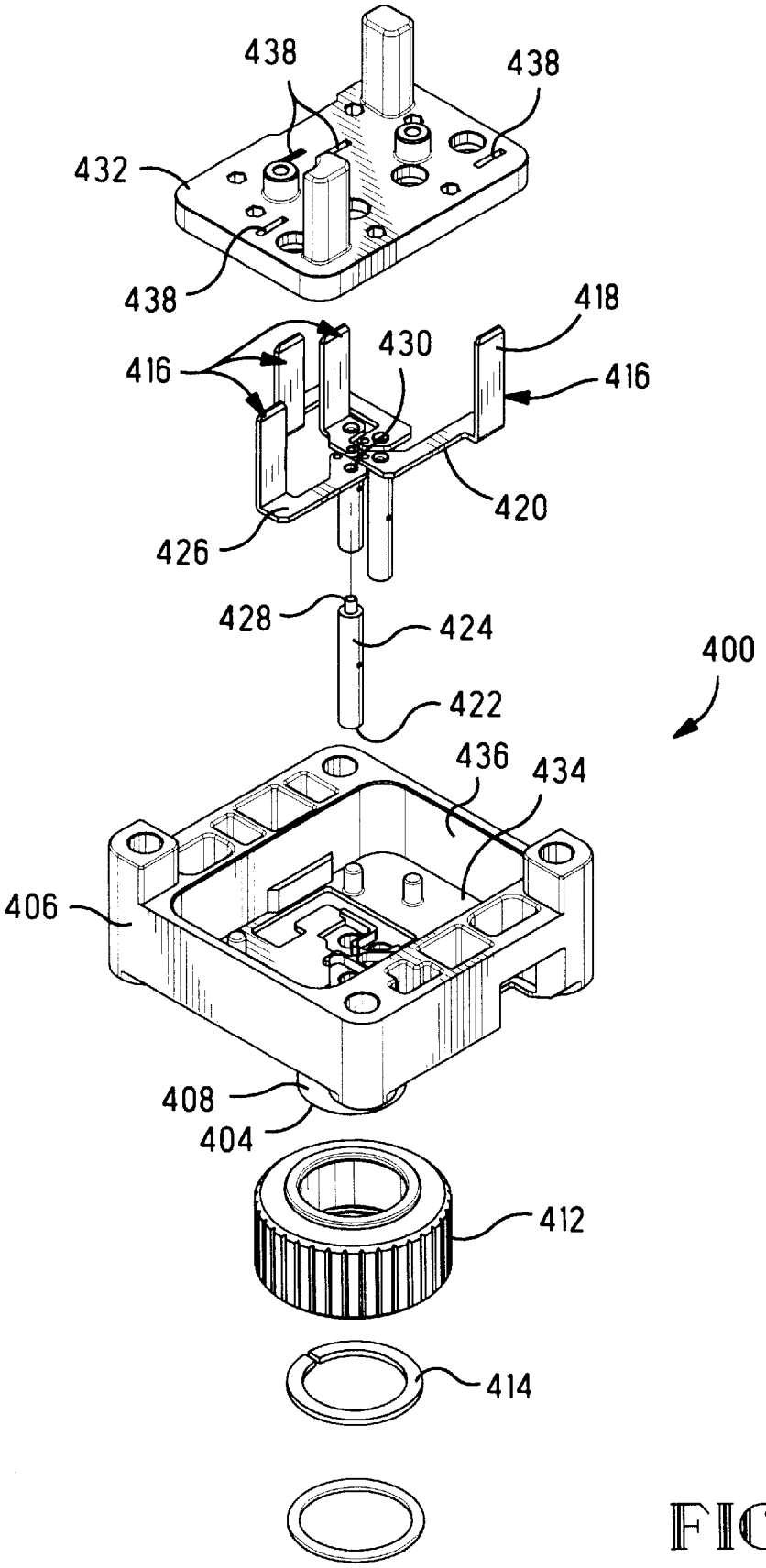
FIG. 15 is an exploded view of the third interface module of FIG. 14.

FIGS. 14 and 15 illustrate a third interface module 400 mated to cable tap connector 10, with second interface 404 adapted to mate with a round cable connector 406 that is of a larger diameter than miniature round cable connector 216 of FIG. 13. Second interface module 400 is similar to first interface module 200 and includes a cylindrical plug portion 408 for receipt into a plug-receiving cavity of connector 406 defined within shroud 410, and outer surface of shroud 410 is threaded. Coupling ring 412 is secured to module 400 by a retention clip 414 in a manner permitting free rotation thereof to become threaded onto shroud 410 of connector 406. An O-ring is also preferably positioned within coupling ring 412 for sealing.

Contact assemblies 416 of module 400 include blade-shaped first contact sections 418 such as are defined on first members 420, and second contact sections 422 such as are defined on second members 424, shown here to be socket contact sections adapted to mate with a pin contact of connector 406. Second members 424 are secured to body sections 426 of first members 420 by rivet-type deformation of annular flange embossments 428 after insertion through corresponding holes 430 of the body sections 426, similar to the deformation depicted in FIGS. 10 and 11 for the second interface module contact assemblies; alternatively, force fitting methods may be utilized. Contact assemblies 416 are disclosed in greater detail in U.S. patent application Ser. No. 09/170,632 filed Oct. 13, 1998 (concurrently herewith) and assigned to the assignee hereof. Insulative retention plate 432 is affixed to surface 434 of housing 406 in large cavity 436 in the same manner as plate 360 of FIG. 9, and secures contact assemblies 416 in module 400 with first contact sections 418 extending through slots 438.

Figure 17:
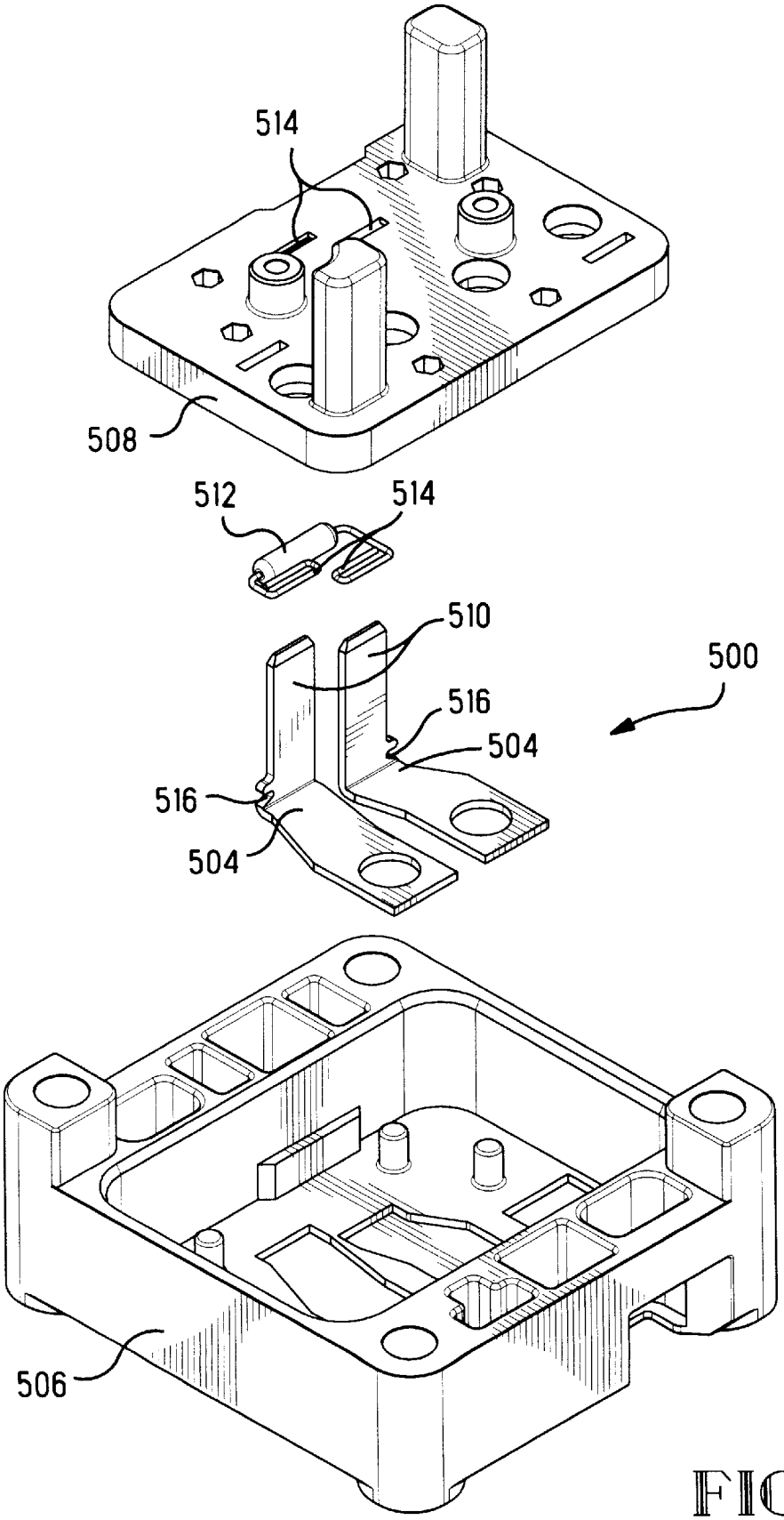
FIG. 17 is an exploded view of the terminator of FIG. 16.

A fourth embodiment of interface module is shown in FIGS. 16 to 18. Terminator 500 defines a first mating interface 502 matable with cable tap connector 10, but includes only two contacts 504 secured in housing 506 by an insulative retention plate 508. Terminator 500 is matable with a cable tap connector placed at an end of cable 12 and serves to prevent reflections from being generated along the signal conductors of cable 12 at the cable end. Blade-shaped contact sections 510 are provided to establish electrical connections only with the signal circuits of cable 12 and cable tap connector 10. A resistor 512 is connected to contacts 504 to dissipate the electrical energy of the signals passing along the signal circuits, preferably with leads 514 fastened at the bases of blade contact sections 510 within notches 516 and thereafter soldered. A clearance pocket (not shown) along the underside of retention plate 508 receives the resistor thereinto upon assembly; such clearance pockets may be provided in all retention plates for the various interface modules, so that any interface module may include a similarly-connected resistor and be placed at a cable end to provide the benefits of a terminator module.

Terminator module 500 is preferably used in conjunction with an end cap 530 of elastomeric material such as of butyl nitrile resin. End cap 530 includes a pocket 532 into surface 534 to receive thereinto and surround and enclose the end portion 536 of cable 12 prior to placement in connector 10; the end cap is shown exploded from connector 10 for illustration purposes only. End cap 530 is disclosed in greater detail in U.S. patent application Ser. No. 09/170,349 filed Oct. 13, 1998 (concurrently herewith) and assigned to the assignee hereof.

End cap 536 includes a pair of projections 538 extend from surface 534 from one side of pocket 532 to be inserted into openings 540 into either cover member 22 or housing 20 of connector 10, with enlarged embossments 542 at ends of projections 538 seated within corresponding enlarged recesses 544 along openings 540 (see FIGS. 2 and 3) and thereafter selfretain to cable tap connector 10, when the cable portion and end cap are placed within the connector. It can be seen that with openings 540 in both the housing and the cover member, cable tap connector 10 is adapted to be placed at either cable end, by easily orienting the end cap appropriately, for projections 538 to correspond with either the openings 540 of the housing or the openings of the cover. The outer surface 546 of terminator module 500 opposed from first mating interface 502 is imperforate.

A dust cover for cable tap connector 10 may be formed by simply utilizing housing 506 and insulative retention plate 508 of terminator module 500, since surface 546 of housing 506 is imperforate. Additional interface modules may be provided, such as an interconnection between two cable tap connectors, by providing identical first mating interfaces on opposed sides of the module housing, or by providing a circuit board along the second mating interface of a module housing that otherwise has a first mating interface identical to that of modules 200,300,400 of FIGS. 7 to 15.

The identical mating interfaces of the interface modules enables an array of different modules that are matable to the same cable tap connector, and are alignable during mating, and latching upon mating in the same manner, as well as assuredly sealing the resulting mated interface therebetween. Other variations and modifications of the present invention may be devised that are within the spirit of the invention and the scope of the claims.

What is claimed is:

1. An electrical interface module of the type having an insulative housing having a first mating interface and a second mating interface and including at least one contact, characterized in that:

said housing has a surface adjacent to said mating interface;

said at least one contact having a transverse body section extending along said housing surface and a first contact section extending orthogonally from said body section and outwardly from said housing surface; and an insulative retention member affixable to said housing along said housing surface outwardly of said body section of said at least one contact, with a corresponding aperture through which extends said first contact section to be exposed along said first mating interface to be electrically connected to an electrical conductor.

2. An electrical interface module as set forth in claim 1 wherein said retention member includes a transverse body section disposed adjacent said housing surface and having a plurality of holes therethrough, and said housing includes corresponding bosses extending from said surface and through respective said holes in a tight force fit, whereby said retention member is secured to said housing.

3. An electrical interface module as set forth in claim 1 wherein said transverse body section of each said at least one contact is seated in a shallow recess of said housing surface.

4. An electrical interface module as set forth in claim 1 wherein said retention member includes clearance holes extending into a housing-proximate surface thereof for receipt thereinto of ends of screw shafts mounted into said second mating interface of said housing.

5. An electrical interface module as set forth in claim 1 wherein said first contact section of each said at least one contact is a blade.

6. An electrical interface module as set forth in claim 5 wherein said retention member includes upstanding projections extending from positions proximate to corners thereof to ends forwardly of a leading end of said blade.

7. An electrical interface module as set forth in claim 6 wherein said housing includes upstanding projections extending therefrom parallel to said upstanding projections of said retention member and spaced laterally therefrom, and extending to ends substantially coplanar with ends of said upstanding projections of said retention member.

8. An electrical interface module as set forth in claim 5 wherein said housing surface is recessed within a large cavity and said body section of said retention member is disposed in said large cavity with said blade of each said at least one contact disposed within said large cavity.

9. An electrical interface module as set forth in claim 1 wherein said housing includes an electrical component electrically connected to two said contacts secured to said housing, said component secured between said retention member and said housing surface.

10. An electrical interface module as set forth in claim 1 wherein an interconnection portion of said body section of each said at least one contact is aligned with an aperture through said housing, a female threaded insert mounted along a second mating interface of said housing is includes a portion extending through a respective said aperture and is interconnected to said interconnection portion of each said at least one contact, and a second contact member is threadable into said female threaded insert along said second mating interface defining a wire termination site thereof for interconnecting a wire to said contact.

11. An electrical interface module as set forth in claim 10 wherein an annular flange of said threaded female insert extends through an aperture of said interconnection portion and is deformed outwardly to secure said insert to said interconnection portion and electrically connect said threaded female insert to said at least one contact.

12. An electrical interface module as set forth in claim 10 wherein each said wire termination site is positioned between a pair of barrier walls to isolate exposed portions of said second contact members and said threaded female insert and said wires.

13. An electrical interface module as set forth in claim 12 wherein a square washer is disposed along a threaded shank of said second contact member to be moved toward said threaded female insert by an enlarged head of said second contact member and compressed against a said wire wrapped around said threaded shank, to increase the metal-to-metal interface of the conductors and the contact assembly defined by said at least one contact, second contact member and said threaded female insert, said pair of barrier walls preventing rotation of said square washer during rotation of said second contact member during connection and disconnection of a wire.

14. An article for being mated to a cable tap connector along an exposed mating interface thereof, the article including a housing having a surface, characterized in that:

an insulative member is secured to said housing along said surface, said insulative member including openings therethrough aligned with contact sections of said cable tap connector exposed along said mating interface, whereby said article protects said exposed mating interface of said cable tap connector against dust when said housing is imperforate along said surface, and said article is electrically matable with said cable tap connector when a plurality of contacts are mounted along said surface of said housing with first contact sections extending through said openings of said insulative member and with second contacts sections extending to a remote face of said housing to be electrically connected to additional conductors.

15. An article as set forth in claim 14 wherein said retention member includes a transverse body section disposed adjacent said housing surface and having a plurality of holes therethrough, and said housing includes corresponding bosses extending from said surface and through respective said holes in a tight force fit, whereby said retention member is secured to said housing.

* * * * *